US007104271B2

(12) United States Patent
Larson et al.

(10) Patent No.: US 7,104,271 B2
(45) Date of Patent: Sep. 12, 2006

(54) ERGONOMIC COLLAPSIBLE CRUTCH

(75) Inventors: Brad Larson, North Logan City, UT (US); Ken Lester, North Logan City, UT (US); Clair Nilson, Logan City, UT (US); Eric Nilson, Providence, UT (US); Mark Nilson, Providence, UT (US)

(73) Assignee: Millennial Medical Equipment, L.L.C., Logan, UT (US)

( * ) Notice: Subject to any disclaimer, the term of this patent is extended or adjusted under 35 U.S.C. 154(b) by 0 days.

(21) Appl. No.: 10/461,578

(22) Filed: Oct. 10, 2003

(65) Prior Publication Data

US 2005/0076940 A1 Apr. 14, 2005

(51) Int. Cl.
*A61H 3/02* (2006.01)

(52) U.S. Cl. ..... 135/73; 135/72; 135/74; 135/82

(58) Field of Classification Search ..... 135/65, 135/68, 71–76, 82; 248/155; 272/70.1–70.3; 428/67, 69
See application file for complete search history.

(56) References Cited

U.S. PATENT DOCUMENTS

| | | | | |
|---|---|---|---|---|
| 26,829 | A | 1/1860 | Bickel | |
| 2,690,188 | A | 9/1954 | Goddard | |
| 2,741,255 | A * | 4/1956 | Neptune | 135/72 |
| 3,133,551 | A * | 5/1964 | Murcott | 135/69 |
| D204,849 | S * | 5/1966 | Thomas et al. | D3/8 |
| 3,335,735 | A * | 8/1967 | Colegrove et al. | 135/69 |
| 3,517,678 | A | 6/1970 | Gilsdorf | |
| 3,635,233 | A * | 1/1972 | Robertson | 135/71 |
| 3,947,140 | A * | 3/1976 | Thomas | 403/108 |
| 4,184,503 | A | 1/1980 | Nakajima | |
| 4,253,478 | A | 3/1981 | Husa | |
| 4,763,680 | A * | 8/1988 | Acosta, Sr. | 135/68 |
| 4,787,405 | A * | 11/1988 | Karwoski | 135/66 |
| 4,869,280 | A | 9/1989 | Ewing | |
| 4,958,651 | A | 9/1990 | Najm | |
| 5,138,058 | A * | 8/1992 | Geisen et al. | 544/295 |
| 5,139,040 | A | 8/1992 | Kelly | |
| 5,201,334 | A | 4/1993 | Tseng | |
| 5,325,879 | A | 7/1994 | Burns | |
| 5,458,143 | A | 10/1995 | Herr | |
| 5,606,985 | A | 3/1997 | Battiston et al. | |
| 5,628,335 | A | 5/1997 | Free | |
| 5,671,765 | A | 9/1997 | Hagberg, Jr. | |
| 5,673,719 | A * | 10/1997 | Shofner | 135/68 |
| 5,711,334 | A | 1/1998 | Roux | |
| 5,720,474 | A | 2/1998 | Sugiyama | |
| 5,725,005 | A | 3/1998 | Yamasaki et al. | |

(Continued)

FOREIGN PATENT DOCUMENTS

| | | |
|---|---|---|
| FR | 371.291 | 3/1907 |

(Continued)

OTHER PUBLICATIONS

"Shock Absorbing Crutch," Allegro Medical, http://www.allegromedical.com/walkers_canes_crutches/crutches, pp. 1-5, printed Jun. 25, 2004.

(Continued)

*Primary Examiner*—Winnie Yip
(74) *Attorney, Agent, or Firm*—Snell & Wilmer L.L.P.

(57) ABSTRACT

An ergonomic collapsible crutch that may have a shock absorbing device, used to facilitate walking. The crutch has only one supporting member in place of two. The supporting member is ergonomically designed. The hand grip is configured to reduce stress on a patient. The crutch has a length adjustment and a collapsibility feature.

18 Claims, 7 Drawing Sheets

U.S. PATENT DOCUMENTS

| | | | |
|---|---|---|---|
| 5,771,910 | A | 6/1998 | Kluttz |
| 5,860,439 | A | 1/1999 | Ostertag |
| 5,924,434 | A | 7/1999 | Cato, III |
| 6,055,998 | A | 5/2000 | Bader |
| 6,164,305 | A | 12/2000 | Herman |
| 6,286,529 | B1 | 9/2001 | Olivera |
| 6,378,541 | B1 | 4/2002 | Matthews |
| 6,537,117 | B1 | 3/2003 | Larson et al. |
| 2001/0027802 | A1 | 10/2001 | McGrath |
| 2003/0098051 | A1 | 5/2003 | Fismer |
| 2004/0025926 | A1 | 2/2004 | Gin et al. |
| 2004/0035453 | A1 | 2/2004 | McGrath |
| 2004/0250845 | A1 | 12/2004 | Rudin et al. |

FOREIGN PATENT DOCUMENTS

| | | | |
|---|---|---|---|
| GB | 2340402 | * | 2/2000 |
| JP | 2001-353010 | | 12/2001 |
| JP | 2003-62021 | * | 3/2003 |
| US | 2001/0032662 A1 | | 10/2001 |

OTHER PUBLICATIONS

"The Design of a Compliant Composite Crutch," Dorota Shortell et al., Department of Veterans Affairs, Journal of Rehabilitation Research and Development, vol. 38, No. 1, pp. 23-32Jan./Feb. 2001.

Thomas Fetterman, Inc., Fetterman Litestix, Titanium Custom Shepherds Crutch, http://www.fetterman-crutches.com/crutchescanes/shepardT.html, pp. 1-2, Oct. 4, 2004.

* cited by examiner

ERGONOMIC COLLAPSIBLE CRUTCH

BACKGROUND

1. Field of the Invention

The present inventions are directed to medical devices for ambulatory care and more particularly ergonomic crutches.

2. Relevant Technology

A crutch is generally thought of as a medical device that is used to support all or part of a patient's body weight. A crutch has traditionally been made of wood or metal, and is ordinarily long enough to reach from a patient's underarm to the walking surface. There is typically a concave surface fitting underneath the arm, and a cross bar for the hand, both used for supporting the body weight. Crutches may be used by a patient for only a few days or, in some instances, a lifetime. Crutches have caused or led indirectly to multiple injuries and disorders despite their ability to transfer weight. In addition, each repetition of an injurious action can produce micro-trauma to the tissues and joints of the body. Although the human body has enormous self-repair abilities, continued exposure to such activities can outweigh these abilities, which then results in injury.

The injuries resulting from crutch use are in part due to the fact that patients overly rely upon the underarm portion to support the body weight. Most crutch designs have not taken into consideration the appropriate contour of the axilla. This has resulted in nerve injuries varying from neuropraxia to complete paralysis of the arm. In addition, the hand grip is rarely contoured to fit a patient's palm. The general construction and design of crutch hand grips does not provide the correct ergonomic orientation between the wrist and forearm even though padding may be present. Failure to achieve correct alignment and padding in the palmar area can result in disorders of wear and tear, including overuse syndromes, repetitive strain injuries, musculoskeletal injuries, and compressive neuropathies. Common injuries resulting in such usage include: carpal tunnel syndrome, wrist tendonitis, medial or lateral elbow epicondylitis, and rotator cuff muscle strains and tears. These disorders appear to be more common in the chronic crutch user, and are the result of repeated stresses on a particular musculoskeletal area.

Crutches have traditionally imported a fixed-length frame having a concave cushioned upper end for placement under the arm, a horizontally-directed rigid handle that extends between two bows that act primarily to carry the weight of a patient, and a lower end configured to contact the ground. Shock absorbing devices have been placed on crutches to lessen the impact to a patient as the body weight is transferred to the walking surface. An added benefit of a shock absorbing device is to assist a patient on uneven ground, as well. Different crutch ends have been designed to provide contact between the crutch and the walking surface. However, an appropriate gripping surface to decrease friction is necessary to prevent the crutch from sliding or slipping. A distal end that not only grips the surface but angulates with the movement of the crutch is necessary to assure full contact.

While various modifications have been attempted, there presently does not exist a crutch that incorporates the appropriate ergonomic structure in a light-weight, sure gripping, user friendly, shock absorbing, and collapsible format.

SUMMARY

The present inventions meet the above-described needs and others. Specifically the present inventions provide an ergonomically designed shock absorbing collapsible crutch to facilitate walking and minimize injurious impact to a patient.

The present inventions present an improved crutch. The crutch has one supporting member in place of two for easier usage and transport. The underarm support surface located toward the proximal end of the supporting member may have interchangeable cushioning pads and is contoured to fit underneath the axilla comfortably. The hand grip located toward the distal end of the supporting member has the appropriate contours for the palm of the hand and ergonomic angulation between the wrist and forearm. An alignment rib connects the supporting member to an adjustable portion to provide support, lengthening and collapsibility. Both the proximal and distal ends of the alignment rib have a snap button to connect to the supporting member and adjustable portion, respectively. A shock absorbing device may be connected to the distal end of the adjustable portion to assist in ambulating over uneven surfaces and to provide a cushioning effect. The distal end of the crutch has a gripping pad that provides appropriate friction between the crutch and the walking environment. It also angulates to provide full contact with the ground throughout the stance phase of the gait cycle. The crutch is collapsible to approximately half of its length allowing for ease in storage and transportation.

BRIEF DESCRIPTION OF THE DRAWINGS

The accompanying drawings incorporated in and forming a part of the specification illustrate preferred embodiments of the present inventions. Some, although not all, alternative embodiments are described in the following description and therefore the drawings are not intended to limit the scope of the inventions. The inventions will be described and explained with additional specificity and detail through the use of the accompanying drawings where.

DETAILED DESCRIPTION OF THE DRAWINGS

Embodiments of the present inventions can be better understood with reference to the drawings where like parts are designated with like numerals throughout.

Figure 1:
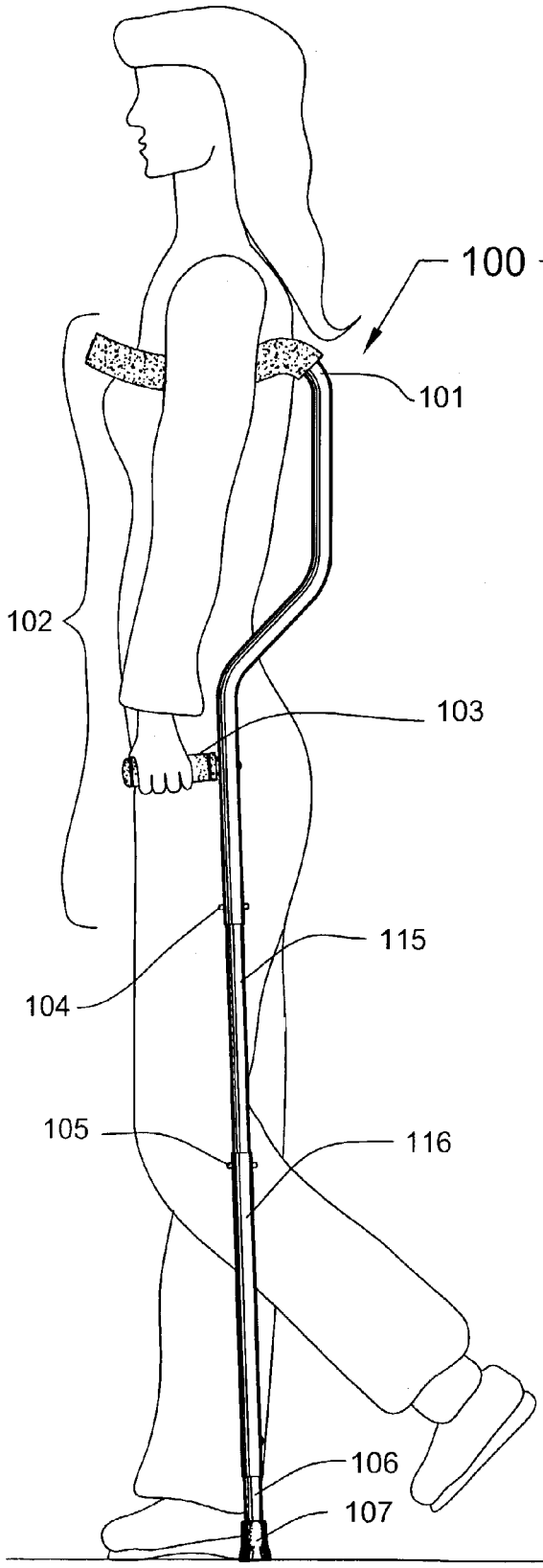
FIG. 1 is a side perspective view of an embodiment of the ergonomic collapsible crutch placed in the forward orientation with respect to a patient.

FIG. 1 illustrates an embodiment of an ergonomic collapsible crutch placed in the forward orientation with respect to a patient. A patient is intended to include any user of the device. The device consists of an underarm support surface 101, one supporting member 102, a hand grip 103, an alignment rib 115, an adjustable portion 116, a shock absorbing portion 106, and a gripping pad 107. The supporting member 102 and adjustable portion 116 each have dual snap buttons 104 and 105, respectively.

The underarm support 101 located toward the proximal end of the supporting member has interchangeable cushioning pads. The underarm support 101 may be padded with an elastomeric material such as EVA, urethane foam, neoprene foam, PVC, natural rubber, cork or any other possible materials. The hand grip 103 is located toward the distal end of the supporting member 102 and has the appropriate contours and ergonomic angulation to fit the palm and align the wrist. The hand grip 103 may be fabricated of elastomeric material such as EVA, urethane foam, neoprene foam, PVC, natural rubber, cork or any other possible materials. An alignment rib 115 connects the supporting member 102 to an adjustable portion 116 to provide support, height adjustment and collapsibility.

The supporting member 102, alignment rib 115 and adjustable portion 116 may be fabricated of metal such as aluminum, steel, or titanium, and are formed in a generally hollow cylindrical shape. The internal and external diameter of the supporting member 102, alignment rib 115 and adjustable portion 116 can be of varying dimensions to accommodate a patient's needs and to provide for the pieces of the crutch to fit together. For example, a pediatric patient may utilize a crutch with a smaller external diameter than an adult patient. A shock absorbing portion 106 may be used at the distal end of the adjustable portion 116 to assist in ambulating over uneven surfaces and to provide a cushioning effect. The distal end of the crutch has a gripping pad 107 that provides appropriate friction between the crutch and the walking environment. The gripping pad 107 may be formed of an elastomeric material such as EVA, urethane foam, neoprene foam, PVC, natural rubber, cork or any other possible materials.

Figure 2:
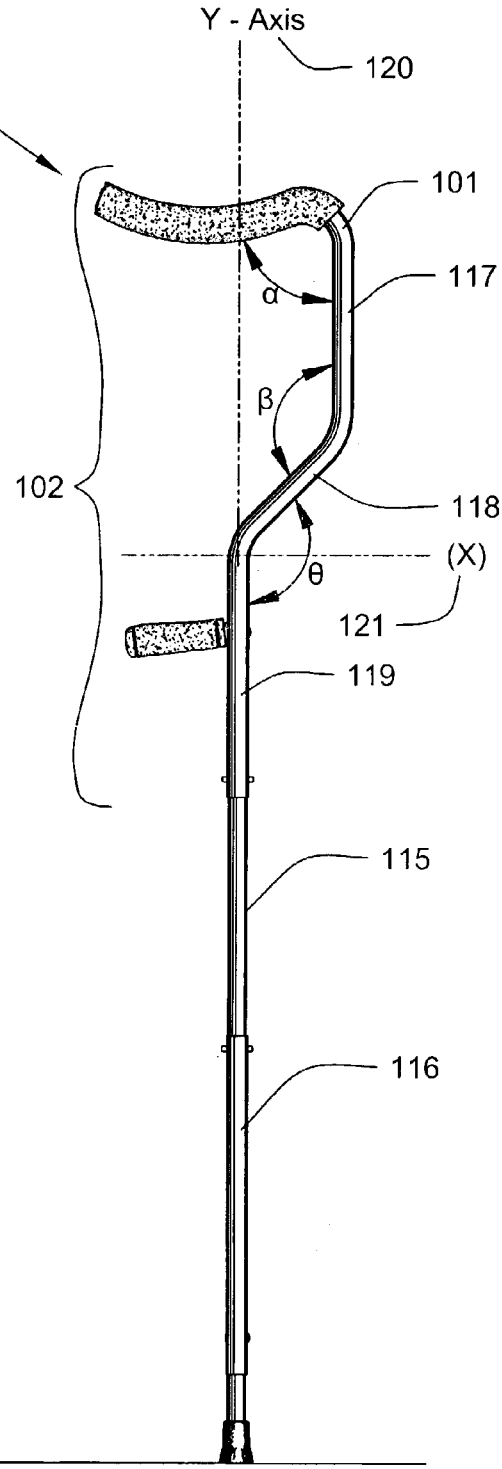
FIG. 2 is a side perspective view of an embodiment of the ergonomic collapsible crutch.

FIG. 2 is a side perspective view of an embodiment of a crutch that has one supporting member 102 for ease of usage and carrying. A vertical line or y-axis 120 is drawn along the center of the alignment rib 115 and adjustable portion 116. A horizontal line or x-axis 121 is drawn perpendicular to the y-axis 120 and transects the supporting member 102. The supporting member 102 consists of four sections: the underarm support 101, the stabilizing portion 117, the middle bend portion 118, and the hand grip portion 119.

The underarm support 101 is generally parallel to the x-axis 121 and it is contoured to fit the underarm of a patient. The length of the underarm support 101 extends considerably beyond either side of a patient's arm. The underarm support 101 has a concave curvature along the top edge and a convex curvature along its underside. The concave curve along the top edge is designed to prevent slippage and provide comfort and stability to a patient.

The stabilizing portion 117 is generally parallel to the y-axis 120. The stabilizing portion 117 is configured to be at an angular orientation $\alpha$ with respect to the underarm support 101 in the range of 45° to 135°. The crutch embodiment of FIG. 2 has an angular orientation $\alpha$ of approximately 90°.

The middle bend portion 118 projects from the stabilizing portion 117 in a downward direction toward the y-axis 120 such that the x-coordinate of the distal end of the middle bend portion 118 is close to the x-coordinate of the proximal end of the hand grip portion 119 in FIG. 2. In one embodiment as depicted in FIG. 2, the x and y coordinates of the distal end of the middle bend portion 118 are approximately (0,0). The middle bend portion 118 is configured to be at an angular orientation $\beta$ with respect to the stabilizing portion 117 in the range of 90° to 180°. In one embodiment of the ergonomic collapsible crutch the angular orientation $\beta$ is approximately 135°.

The hand grip portion 119 projects from the distal end of the middle bend portion 118 in a generally vertical direction. In one embodiment of the ergonomic collapsible crutch the hand grip portion 119 directly follows the y-axis 120 such that the x-coordinate of the proximal end of the hand grip portion 119 is close to the x-coordinate of the distal end of the hand grip portion 119. In one embodiment as depicted in FIG. 2, the x coordinate of the entire hand grip portion 119 is approximately zero. The hand grip portion 119 is configured to be at an angular orientation $\theta$ with respect to the middle bend portion 118 in the range of 90° to 180°. In one embodiment of the ergonomic collapsible crutch the angular orientation $\theta$ is approximately 135° such that the angular orientation $\beta$ is approximately the same as the angular orientation $\theta$. The hand grip portion 119 extends beyond the hand grip 103 to provide dual snap buttons for the folding mechanism 104 of the crutch allowing for collapsibility.

The alignment rib 115 provides the connection between the supporting member 102 via the hand grip portion 119 and the adjustable portion 116. The hand grip portion 119 of the supporting member 102 includes dual snap buttons 105 to accommodate patients of varying heights. Alternative devices may be used as a latching mechanism instead of the illustrated dual snap buttons 105. For example, a single pin radially biased outward would be sufficient. In one embodiment of the ergonomic collapsible crutch the adjustable portion 116 is connected to a shock absorbing portion 106 to lessen impact on a patient. Additionally, a gripping pad 107 is at the end of the crutch to provide stability and grip on uneven or slick surfaces.

Figure 3:
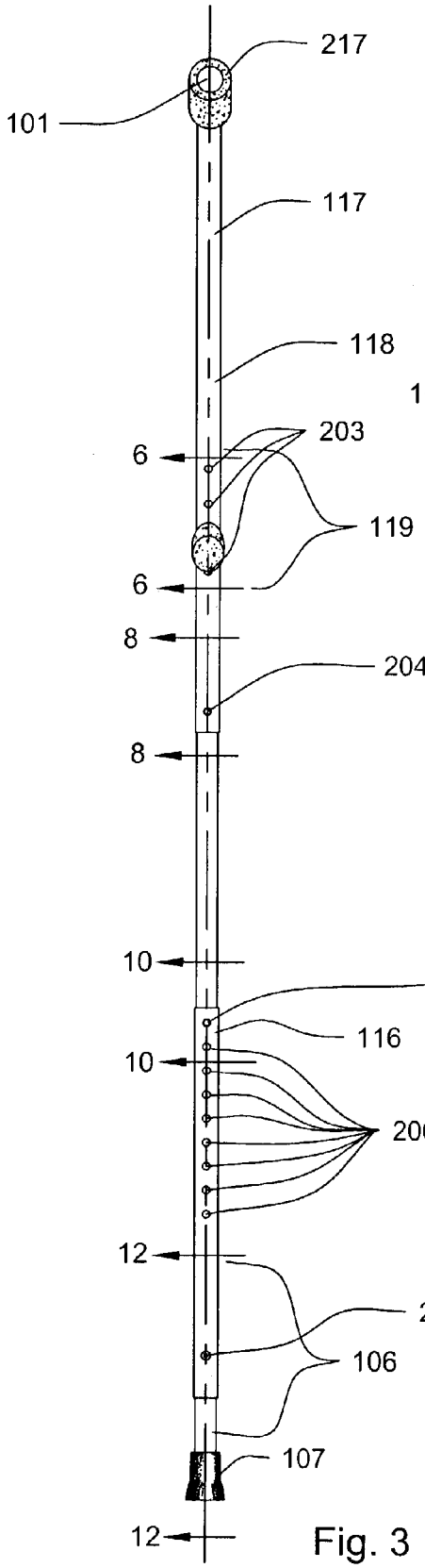
FIG. 3 is front view of an embodiment of the ergonomic collapsible crutch.
Figure 4:
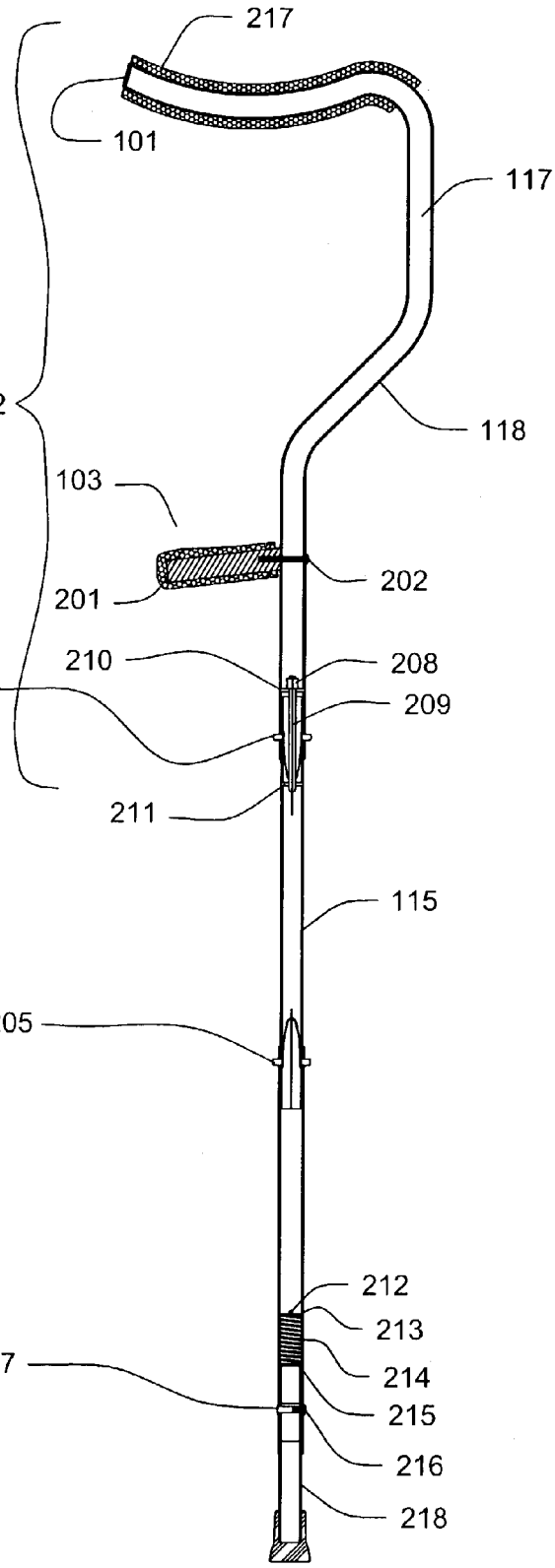
FIG. 4 is a cross-sectional side view of an embodiment of the ergonomic collapsible crutch.

FIGS. 3 and 4 illustrate the underarm pad 217, hand grip portion 119, the two snap assembly of the folding mechanism 204, the two snap assembly of the height adjustment mechanism 205, the shock absorbing portion 106 and the gripping pad 107.

The underarm pad 217 may be generally cylindrical in shape and may be fabricated with an elastomeric material such as EVA, urethane foam, neoprene foam, PVC, natural rubber, cork or any other possible materials. The exterior diameter of the underarm pad 217 may be custom designed to fit a patient's desired thickness and density. The interior diameter of the underarm pad 217 may also be custom designed to fit the diameter of the underarm support 101. In addition, the underarm pad 217 is removable/replaceable in the event an alternative material, thickness, diameter and/or density is desired. The underarm support 101 is a portion of the supporting member 102 and is connected to the hand grip portion 119, via the stabilizing portion 117 and the middle bend portion 118.

The hand grip portion 119 has a series of diametrically opposed hand grip adjustment apertures 203 to allow the hand grip 103 to be placed in a variety of positions to accommodate height adjustment and a patient's desired orientation of the crutch. The hand grip portion 119 is further described and illustrated in FIGS. 5 through 7. The distal end of the hand grip portion 119 extends beyond the hand grip 103 to provide dual snap buttons for the folding section 104 of the crutch allowing for collapsibility. The dual snap buttons for the folding mechanism 204 are designed to release the crutch into two connected pieces by disengaging the hand grip portion 119 from the alignment rib 115. Alternative devices may be used as a latching mechanism instead of the illustrated dual snap buttons 104. For example, a single pin radially biased outward would be sufficient. The folding mechanism is further described in illustrated in FIGS. 9 and 10. The alignment rib 115 engages with the adjustable portion 116 via dual snap buttons 205 for height adjustment. The adjustable portion 116 has a series of diametrically opposed apertures 206 allowing for a customized crutch length to accommodate varying patient heights.

Figure 5:
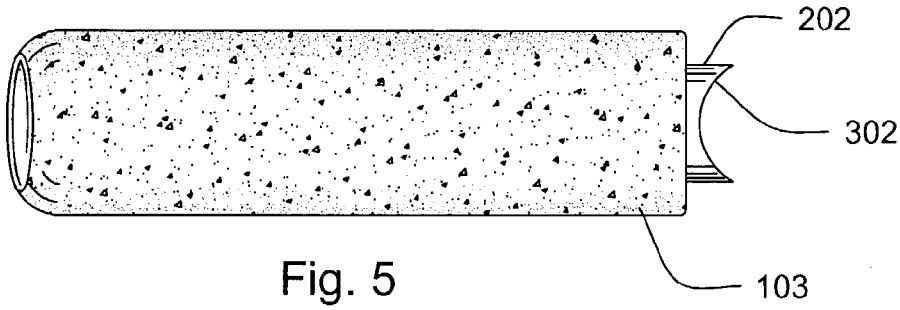
FIG. 5 is a side view of an embodiment of the hand grip portion.
Figure 7:
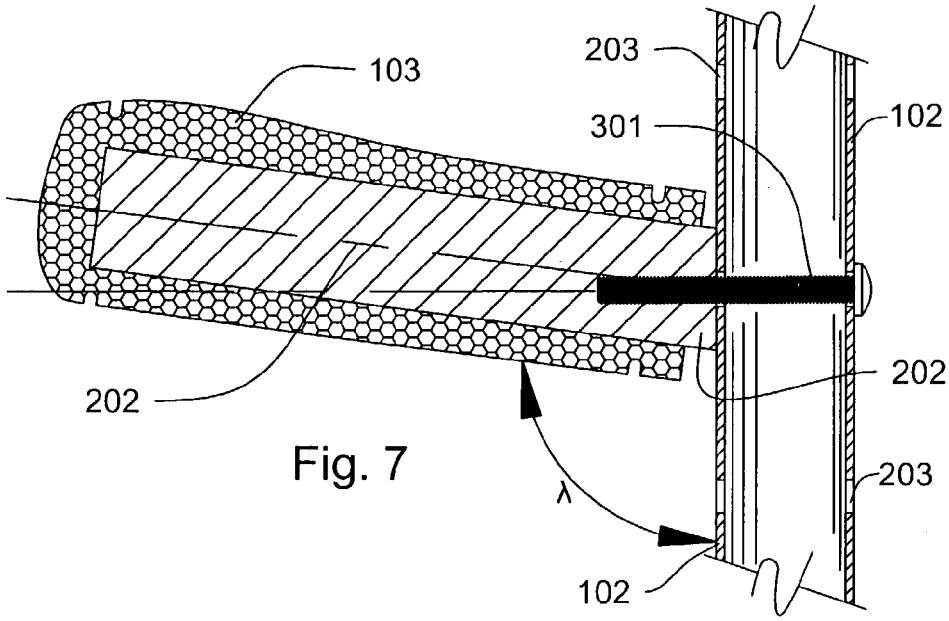
FIG. 7 is a cross-sectional side view of an embodiment of the hand grip in the upward position.
Figure 6:
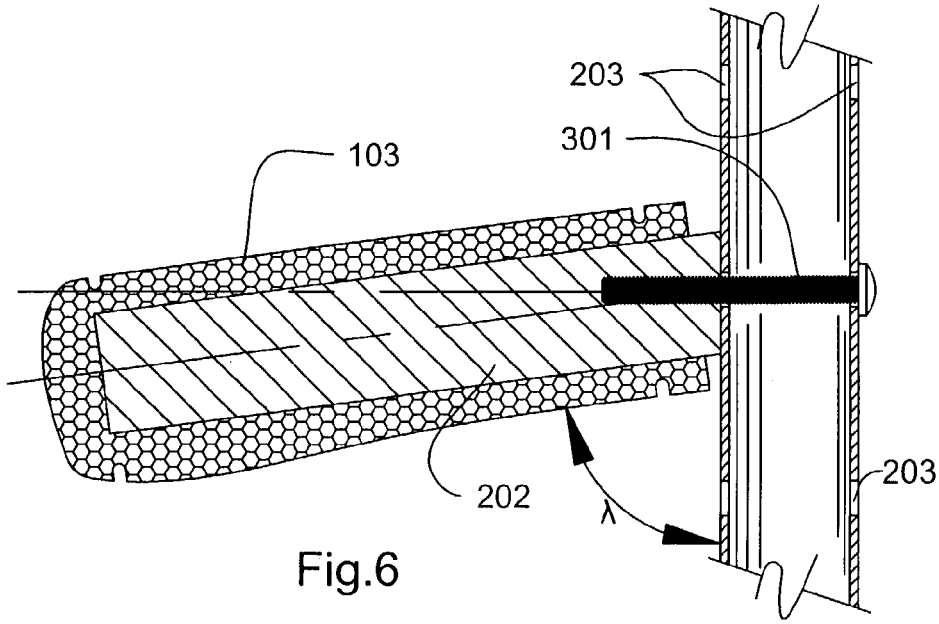
FIG. 6 is a cross-sectional side view of an embodiment of the hand grip in the downward position.

FIGS. 5 through 7 provide alternative embodiments of a hand grip 103 for use on an ergonomic collapsible crutch. (U.S. Pat. No. 3,517,678 is hereby incorporated by reference in its entirety.) The hand grip 103 is adjustable to maintain the wrist of a patient in the neutral position, which position has been described as a line passing though the middle of the third metacarpal being parallel to a line passing through the middle of the radius. The adjustability of hand grip 103 allows for easier grip, decreased stress and decreased risk of injury to the wrist. The ergonomic design of the hand grip 103 encourages spreading of the force load from grasping forces over as large an area as possible.

The hand grip 103 is connected to the hand grip portion 119 of the supporting member 102 via a hand grip shaft 202. In one embodiment of the ergonomic collapsible crutch the hand grip 103 is secured to the supporting member 102 via a machine screw 301 that extends through a set of hand grip adjustment apertures 203.

The hand grip may be of varying diameters to accommodate the palm of a patient. In one embodiment of the ergonomic collapsible crutch, the hand grip 103 is about 1 cm smaller than a patient's inside grip diameter. The pressure of the hand grip 103 on the hand should be distributed over the fat pads of the hands. The contour of the hand grip 103 corresponds with the curve of the transverse palmar arch and the natural palmar curve of the fingers as they flex toward the palm.

The length of the hand grip 103 should be long enough to evenly distribute the grasping forces over the palm of the hand. A grip with a length in the range of about 4 to about 5 inches or from about 10 to about 12 centimeters provides sufficient area to spread the grasping force over the palm of an average adult patient. However, the length of the hand grip 103 may be customized to the palm of any patient.

Figure 8:
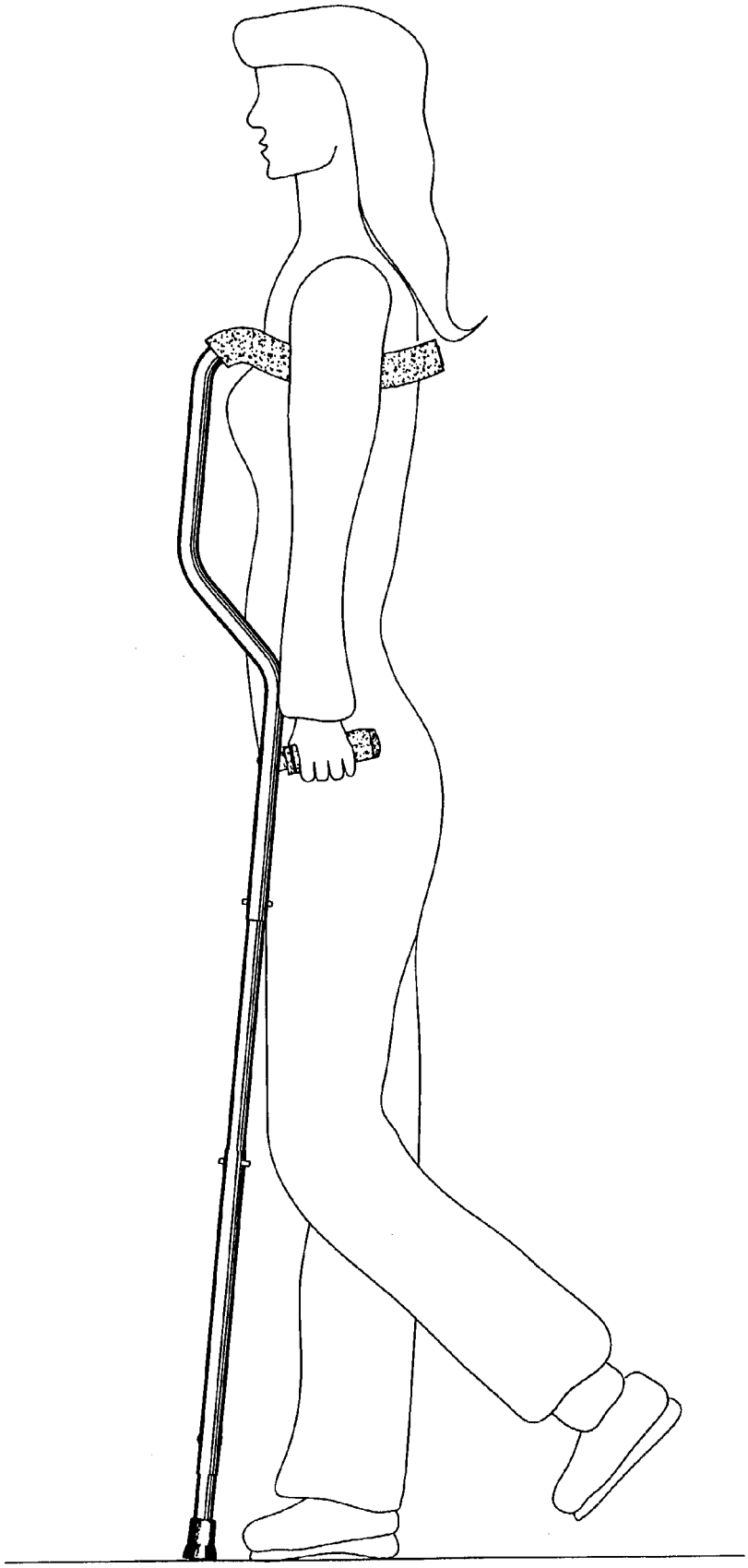
FIG. 8 is a side perspective view of an embodiment of the ergonomic collapsible crutch placed in the reverse orientation with respect to a patient.

The hand grip 103 is oriented to maintain the wrist in a neutral position throughout a patient's walking motion. The neutral position is generally maintained by keeping a patient's third metacarpal generally aligned with his radius. Therefore, the hand grip 103 is angled outwardly from the y-axis 304 at an angle λ from the x-axis 303 allowing for a patient's third metacarpal to be more generally aligned with his radius. The edge of the hand grip shaft 302 that contacts the supporting member 102 may be manufactured to provide complete contact such that when the hand grip 103 is at an angle λ there is little to no gap between the edge of the hand grip shaft 302 and the supporting member 102. The angle λ is determined by a variety of factors including the orientation of the crutch. The crutch may be used in the forward orientation as illustrated in FIG. 1 or the reverse orientation as illustrated in FIG. 8. In addition, one or two crutches may be used by a patient. A crutch placed in the forward orientation with respect to a patient, as illustrated in FIGS. 1 and 6, requires an angle λ ranging from about 90° to about 45°. This range is sufficient to at least partially align the third metacarpal with the radius and place the wrist in the neutral position. Additionally, one embodiment of the ergonomic collapsible crutch has an angle λ ranging from about 80° to about 60°. An angle λ in the range from about 75° to about 65° accommodates most adult patients.

A crutch placed in the reverse orientation with respect to a patient, as illustrated in FIGS. 7 and 8 requires an angle λ ranging from about 90° to about 135°. This range is sufficient to at least partially align the third metacarpal with the radius and place the wrist in the neutral position. Additionally, one embodiment of the ergonomic collapsible crutch has an angle λ ranging from about 100° to about 120°. An angle λ in the range from about 105° to about 115° accommodates most adult patients.

Figure 9:
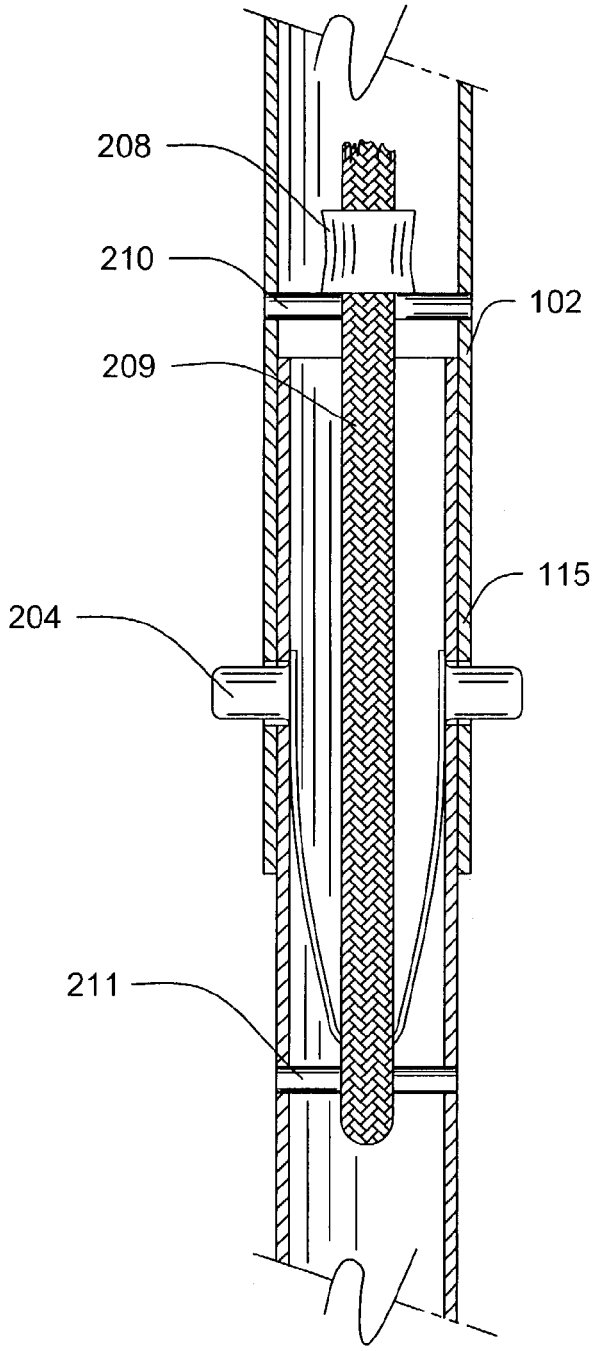
FIG. 9 is a cross-sectional side view of an embodiment of the crutch folding mechanism.
Figure 10:
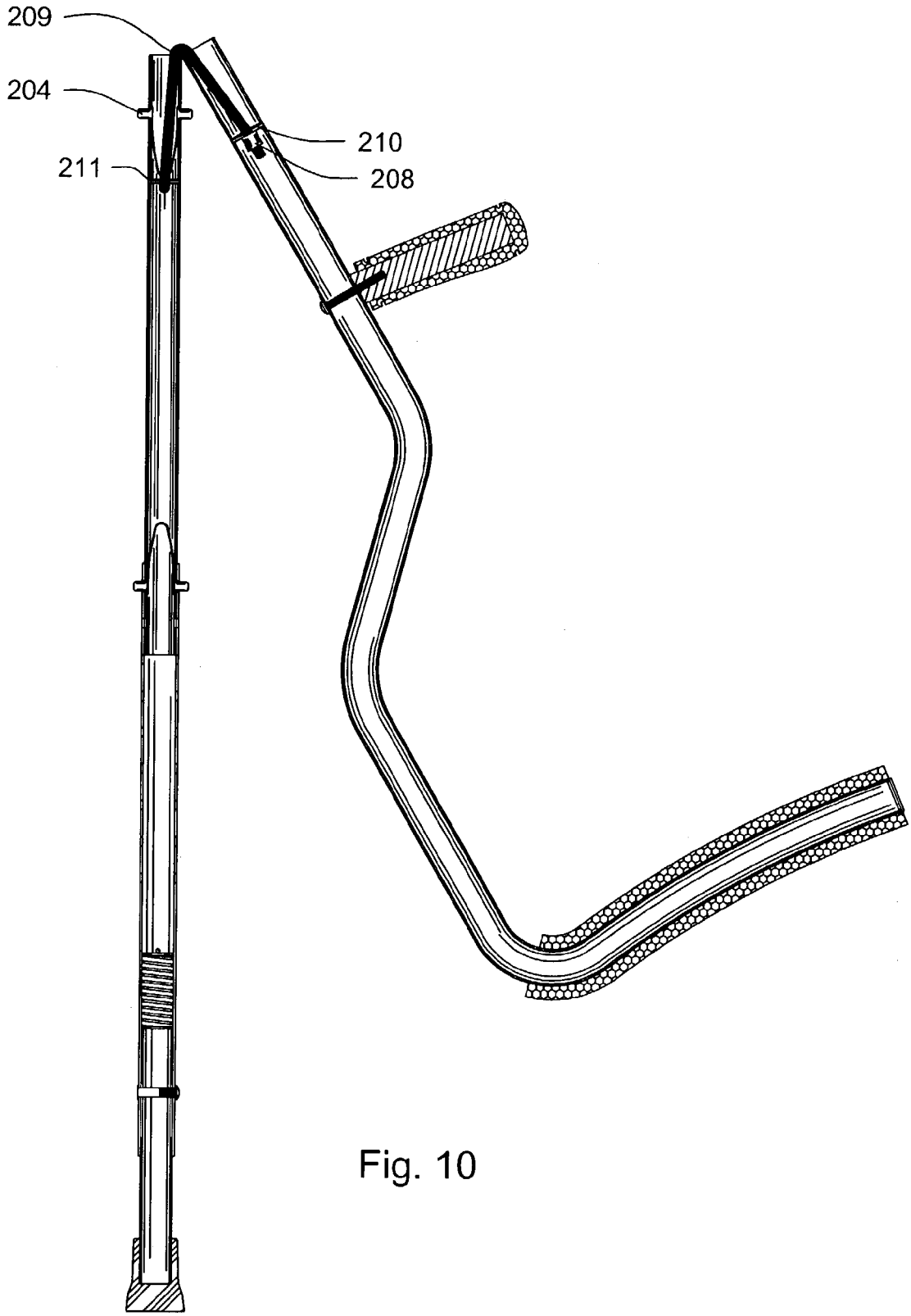
FIG. 10 is a cross-sectional side view of an embodiment of the crutch in a partially folded position.
Figure 12:
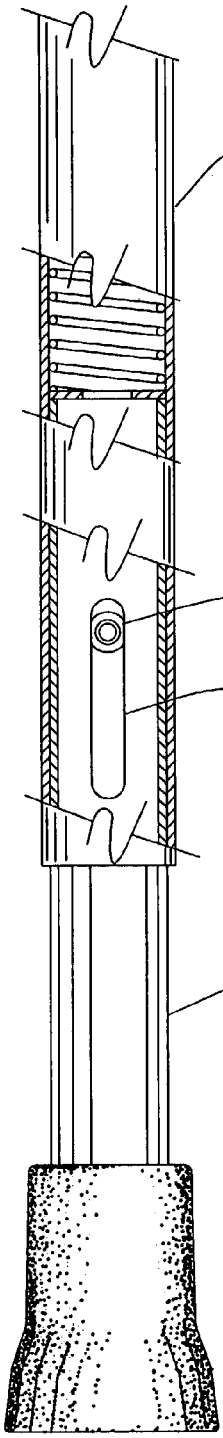
FIG. 12 is a cross-sectional side view of an embodiment of the crutch shock absorbing mechanism.

FIGS. 9 and 10 illustrate an embodiment of the crutch folding mechanism. The ergonomic collapsible crutch is collapsible to approximately half or less of its length allowing for ease in storage and transportation. In one embodiment, the crutch can be disengaged in preparation for collapsing by depressing both of the dual snap buttons 204 while pulling the supporting member 102 and the alignment rib 115 in opposite directions. Once the crutch is disengaged, an elastic cord 209 provides continued attachment and flexibility between the supporting member 102 and the alignment rib 115, such that the crutch may be folded. The elastic cord 209 runs through a portion of the interior of the supporting member 102 and alignment rib 115. The elastic cord 209 may be attached to the supporting member 102 via a supporting member elastic retaining pin 210. A clinch ring 208 may be used to secure the elastic cord 209 to the supporting member elastic retaining pin 210. A similar mechanism may be used to attach the elastic cord 209 to the alignment rib 115, such that an alignment rib elastic retaining pin 211 secures the elastic cord 209. Alternative means of attachment of the elastic cord and folding of the crutch are possible.

Figure 11:
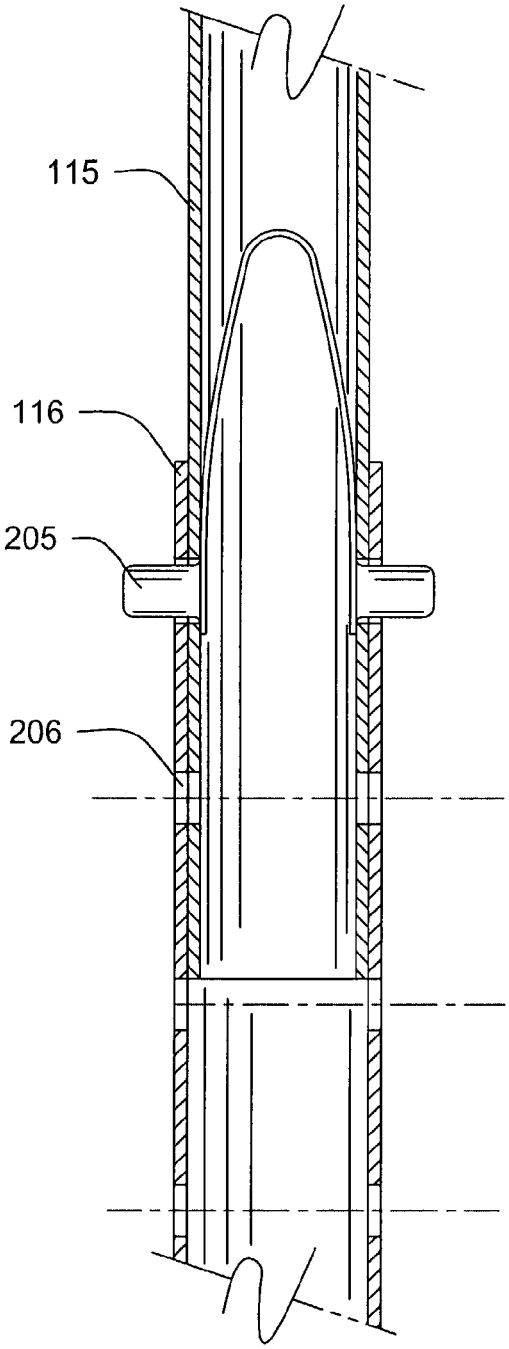
FIG. 11 is a cross-sectional side view of an embodiment of the crutch height adjustment mechanism.

In one embodiment, the height of the crutch may be adjusted by providing an adjustable portion 116 as shown in FIG. 11. Such adjustment can include but is not limited to dual snap buttons 205. The crutch height is adjusted by depressing the buttons 205 causing the alignment rib 115 to be released from the adjustable portion 116. This allows the alignment rib 115 to be telescoped into or out of the adjustable portion 116. Once the crutch is at the desired length, the alignment rib 115 can be locked into place by allowing the dual snap buttons 115 to extend through a set of diametrically opposed apertures 206. Multiple crutch heights are accommodated for by multiple sets of these apertures 206. The crutch may be extended of contracted to a variety of lengths to accommodate children and adults. Additionally, the length of the alignment rib 115 may be customized to provide a desired crutch length.

Figure 13:
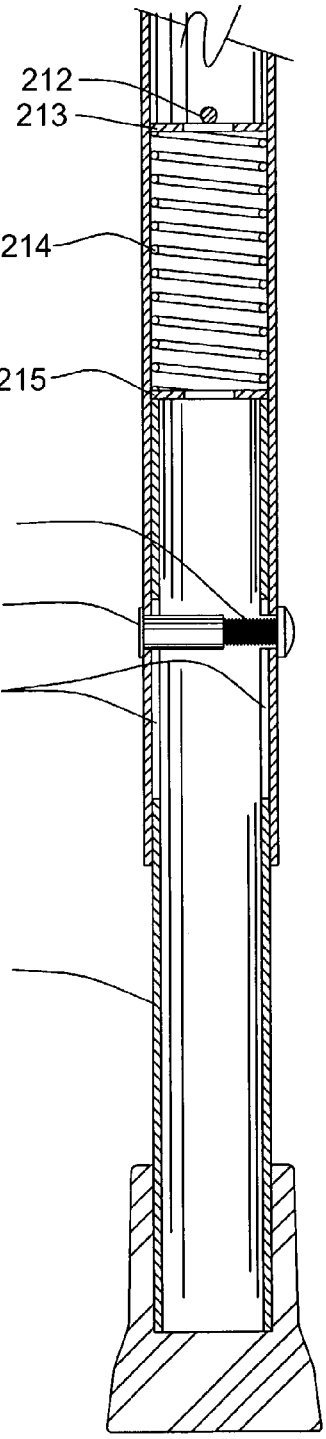
FIG. 13 is a cross-sectional side view of an embodiment of the crutch shock absorbing mechanism in the relaxed position.
Figure 14:
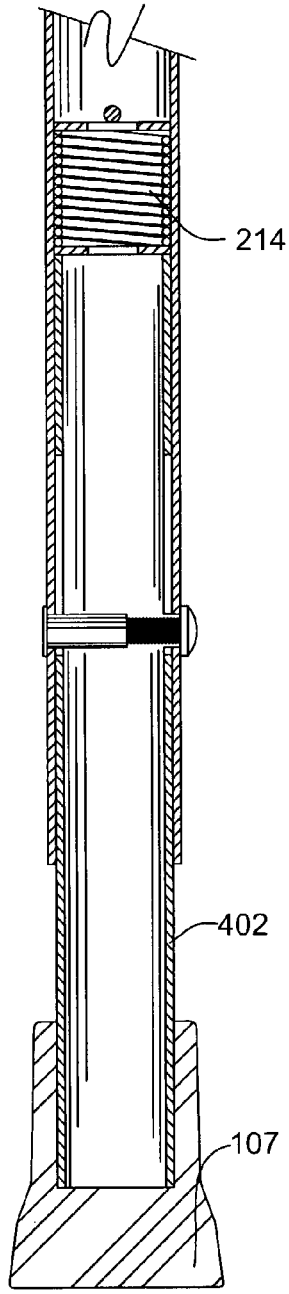
FIG. 14 is a cross-sectional side view of an embodiment of the crutch shock absorbing mechanism in the compressed position.

A shock absorbing portion 106 may be included in an ergonomic collapsible crutch. In one embodiment a spring 214 is used to provide a shock absorbing mechanism, as illustrated in FIGS. 4, 12, 13 and 14. Alternative shock absorbing devices are possible, including but not limited to gas assisted shocks, hydraulic shocks and pneumatic shocks. The spring 214 is contained within the lower half of the adjustable portion 116. The proximal end of the spring 214 is held in place with a retaining pin 212 and an upper retaining washer 213. The distal end of the spring 214 contacts the proximal end portion of the shock bar 402 via a lower retaining washer 215. The shock bar 402 has a smaller external diameter than the internal diameter of the adjustable portion 116, such that the shock bar 402 can telescope into and out of the adjustable portion as required by the pressure exerted by a patient. A machine screw 216 connected with a tee nut 207 secures the adjustable portion 116 to the shock bar 402. The tee nut 207 extends through a longitudinally elongated aperture 401 in which the machine screw 216 connected with the tee nut 207 can slide. FIG. 13 illustrates a shock absorbing portion 106 in its relaxed state such that the spring 214 is extended. FIG. 14 illustrates a shock absorbing portion in its compressed state such that the spring 214 is compressed. The shock bar 402 is finished off at its end with a gripping pad 107 that acts as a support element on the ground. This pad 107 is made of the appropriate elastomeric material with its gripping surface ribbed, corregated, spiked, or otherwise made to grip the surface to reduce friction. The pad is made such that the proximal portion of the pad fits onto the distal end of the crutch, with an articulation with the distal portion such that it can accommodate 120 degrees of motion. The articulation may include a hinge, ball in socket, sliding joint, or other means to allow for movement.

While the present crutch has been described and illustrated in conjunction with a number of specific examples, those skilled in the art will appreciate that variations and modifications may be made without departing from the principles herein illustrated, described, and claimed. The present inventions, as defined by the appended claims, may be embodied in other specific forms without departing from its spirit or essential characteristics. The configurations of articles described herein are to be considered in all respects as only illustrative, and not restrictive. All changes that come within the meaning and range of equivalency of the claims are to be embraced within their scope.

We claim:

1. An ergonomic crutch comprising:

a supporting member that has a vertical axis, the support member comprising a generally horizontally oriented underarm support and a generally vertically oriented hand grip portion wherein the supporting member further comprises a stabilizing portion extending at an angular orientation from the underarm support in the range of about 45° to about 135° and a middle bend portion projecting from the stabilizing portion and projecting toward the vertical axis such that the middle bend portion is at an angular orientation to the stabilizing portion in the range of about 90° to 180°, wherein the middle bend portion is attached to the generally vertically oriented hand grip portion;

an adjustable portion that is positioned generally along the vertical axis, the adjustable portion being attached to the supporting member; and a hand grip extending outwardly from the generally vertically oriented hand grip portion at an angle of about 10° to about 30° downwardly below horizontal, and wherein the hand grip extends outwardly from the hand grip portion at an angle such that the wrist of a user is generally maintained in a neutral position wherein the user's third metacarpal is generally aligned with the user's radius.

2. The ergonomic crutch of claim 1 wherein the hand grip extends outwardly from the generally vertically oriented hand grip portion at an angle of about 15° to about 25° downwardly below horizontal.

3. The ergonomic crutch of claim 1, further comprising a shock absorbing device connected to the adjustable portion.

4. The ergonomic crutch of claim 1 wherein the stabilizing portion is at an angular orientation to the underarm support of about 90°.

5. The ergonomic crutch of claim 1 wherein the middle bend portion is at an angular orientation to the stabilizing portion in the range of about 135°.

6. The ergonomic crutch of claim 1 wherein the underarm support has a concave curvature along its top edge and a convex curvature along its bottom edge.

7. The ergonomic crutch of claim 1 wherein the crutch further comprises a folding section.

8. The ergonomic crutch of claim 1 further comprising an alignment rib that is attached to the adjustable portion.

9. An ergonomic crutch comprising:

a supporting member that has a vertical axis, the support member comprising:

a generally horizontally oriented underarm support;

a stabilizing portion connected to the underarm support at an angular orientation to the underarm support in the range of about 45° to about 135°;

a middle bend portion projecting from the stabilizing portion and projecting toward the vertical axis such that the middle bend portion is at an angular orientation to the stabilizing portion in the range of about 90° to 180°; and a generally vertically oriented hand grip portion wherein the middle bend portion is attached to the generally vertically oriented hand grip portion;

an adjustable portion that is positioned generally along the vertical axis, the adjustable portion being attached to the supporting member; and a hand grip extending outwardly from the generally vertically oriented hand grip portion at an angle of about 10° to about 30° downwardly below horizontal, and wherein the hand grip extends outwardly from the hand grip portion at an angle such that the wrist of a user is generally maintained in a neutral position wherein the user's third metacarpal is generally aligned with the user's radius.

10. The ergonomic crutch of claim 9 wherein the hand grip extends outwardly from the generally vertically oriented hand grip portion at an angle of about 15° to about 25° downwardly below horizontal.

11. The ergonomic crutch of claim 9 wherein the underarm support has a concave curvature along its top edge and a convex curvature along its bottom edge.

12. The ergonomic crutch of claim 11 wherein the crutch further comprises a folding section.

13. The ergonomic crutch of claim 12 further comprising an alignment rib that is attached to the adjustable portion.

14. An ergonomic crutch comprising:

a supporting member that has a vertical axis, the support member comprising a generally horizontally oriented underarm support, wherein the underarm support has a concave curvature along its top edge and a convex curvature along its bottom edge, and a generally vertically oriented hand grip portion wherein the supporting member further comprises a stabilizing portion extending at an angular orientation from the underarm support in the range of about 45° to about 135° and a middle bend portion projecting from the stabilizing portion and projecting toward the vertical axis such that the middle bend portion is at an angular orientation to the stabilizing portion in the range of about 90° to 180°, wherein the middle bend portion is attached to the generally vertically oriented hand grip portion.;

an adjustable portion that is positioned generally along the vertical axis, the adjustable portion being attached to the supporting member; and a hand grip extending outwardly and downwardly below horizontal from the generally vertically oriented hand grip portion, wherein the hand grip extends outwardly from the hand grip portion at an angle such that the wrist of a user is generally maintained in a neutral position wherein the user's third metacarpal is generally aligned with the user's radius.

15. The ergonomic crutch as in claim 14 wherein the stabilizing portion is at an angular orientation to the underarm support of about 90°.

16. The ergonomic crutch as in claim 14 wherein the middle bend portion is at an angular orientation to the stabilizing portion in the range of about 135°.

17. The ergonomic crutch of claim 14 wherein the crutch further comprises a folding section.

18. The ergonomic crutch of claim 14 further comprising an alignment rib that is attached to the adjustable portion.

* * * * *